US007658084B2

(12) United States Patent
Bhatti et al.

(10) Patent No.: US 7,658,084 B2
(45) Date of Patent: Feb. 9, 2010

(54) EVAPORATIVE COOLER

(75) Inventors: Mohinder Singh Bhatti, Amherst, NY (US); Ilya Reyzin, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 238 days.

(21) Appl. No.: 11/732,294

(22) Filed: Apr. 3, 2007

(65) Prior Publication Data

US 2008/0245089 A1 Oct. 9, 2008

(51) Int. Cl.
*F25D 23/12* (2006.01)

(52) U.S. Cl. ..... 62/259.4; 62/121

(58) Field of Classification Search ..... 62/121, 62/259.4, 285, 304

See application file for complete search history.

(56) References Cited

U.S. PATENT DOCUMENTS 6,976,365 B2 * 12/2005 Forkosh et al. ..... 62/94

* cited by examiner

*Primary Examiner*—Melvin Jones
(74) *Attorney, Agent, or Firm*—Patrick M. Griffin

(57) ABSTRACT

A refrigeration assembly includes a pair of refrigerated chambers defined within a working chamber. The refrigerated chambers include channel walls extending parallel to one another and spaced apart, and first and second panels extending channel walls to define a working channel for separating the working chamber into sub-chambers. Apertures defined in the panels allow airflow from the sub-chambers into the working channel, and a supply of water wets the panels and a first section of the refrigerated chambers. Air enters the sub-chambers and flows over the first sections of the refrigerated chambers for direct evaporative cooling. A portion of the air bleeds through the apertures and evaporates water from the panels prior to flowing over the second sections of the refrigerated chambers for indirect evaporative cooling.

19 Claims, 3 Drawing Sheets

FIG - 2
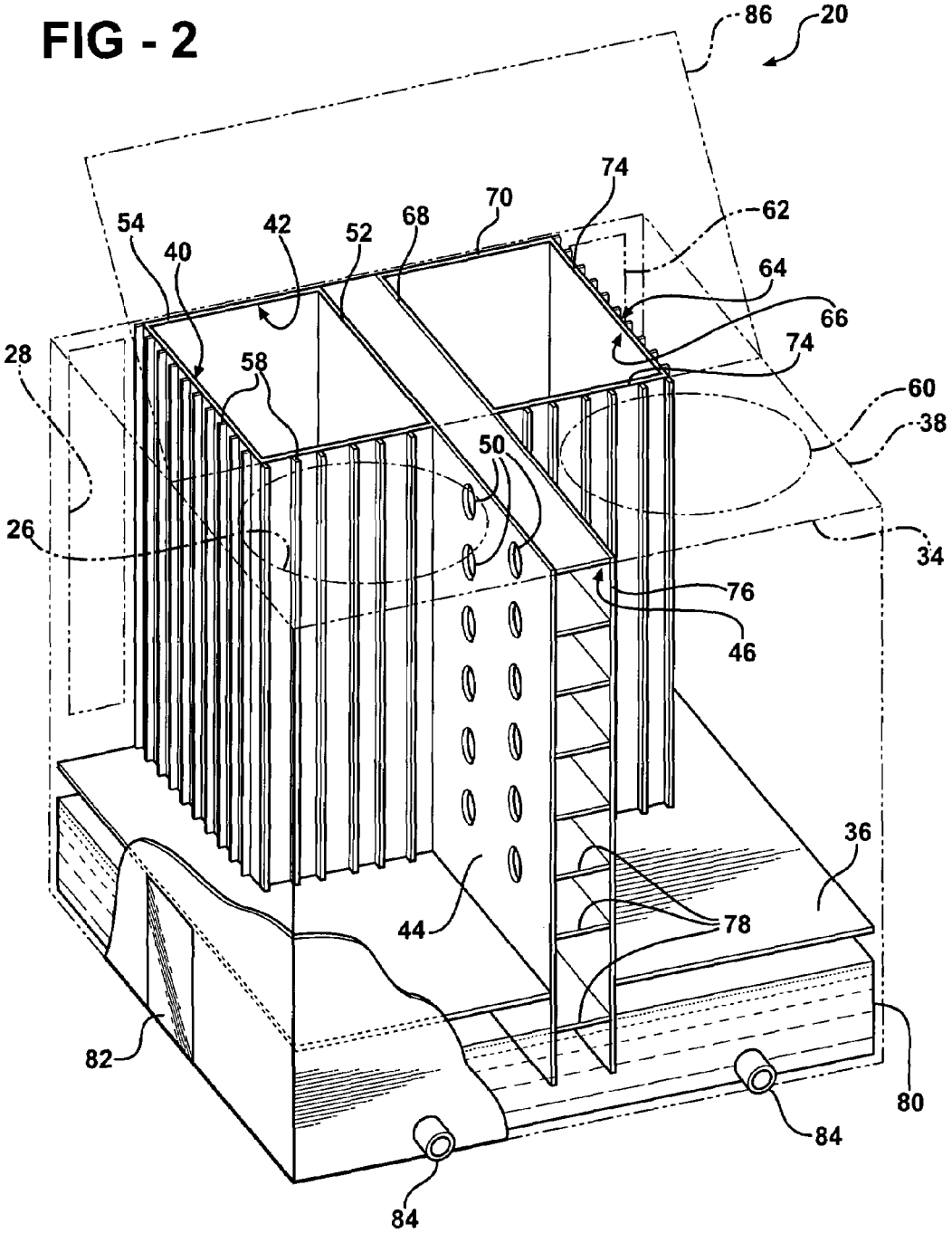
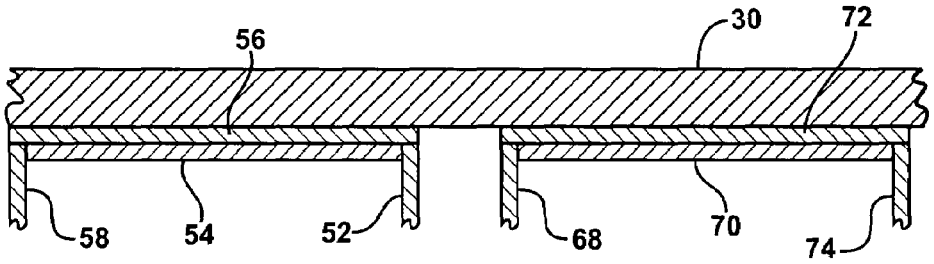
FIG - 3

EVAPORATIVE COOLER

BACKGROUND OF THE INVENTION

1. Field of the Invention

The subject invention relates generally to a refrigeration assembly.

2. Description of the Prior Art

Known refrigeration assemblies define a working chamber with air inlets and outlets for receiving and discharging an airstream. Inner walls define a refrigerated chamber within the working chamber and isolated from the airstream. Heat is transferred from the exterior of the inner walls to the airstream flowing between the air inlet and air outlet. Since the heat capacity of water is significantly higher than that of air, a supply of water can be provided to abstract heat in the heat exchange process. U.S. patent application Ser. No. 11/633,156, assigned to the assignee of the present invention, provides the supply of water in fluid communication with the exterior of the inner walls. The heat from the refrigerated chamber evaporates the water, drawing the latent heat of evaporation away from the refrigerated chamber's contents, cooling the refrigerated chamber by a method known generally as direct evaporative cooling. U.S. patent application Ser. No. 11/526,981, also assigned to the assignee of the present invention, provides a panel extending rearwardly from the refrigerated chamber and in fluid communication with the supply of water. The panel includes a plurality of apertures and draws the latent heat of evaporation from the air as it passes over the panel and through the apertures. The air is then passed over the refrigerated chamber, cooling the refrigerated chamber by a method known generally as indirect evaporative cooling.

SUMMARY OF THE INVENTION AND ADVANTAGES

The subject invention provides for such an assembly including a first panel in fluid communication with the supply of water for wetting the first panel inside of the working chamber. The first panel extends from one of the first inner walls separating the working chamber into a first working sub-chamber contiguous with a first section of the first refrigerated chamber and a working channel contiguous with a second section of the first refrigerated chamber. One of the outer walls includes a channel outlet and the first panel includes apertures for airflow from the first working sub-chamber through the working channel over the second section of the first refrigerated chamber and out the channel outlet.

The invention also provides a method of cooling a container including, evaporating moisture into a first division of a first airstream from a first section of the exterior of a first refrigerated chamber to cool the first refrigerated chamber. Moisture is also evaporated into a second division of the first airstream at a first position spaced from the first refrigerated chamber to cool the second division of the first airstream. The second division of the first airstream is then passed over a second section of the exterior of the first refrigerated chamber to cool the first refrigerated chamber.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2 is a perspective view of the refrigeration assembly of FIG. 1 showing a first and second refrigerated chamber and first and second panels and water tank;

FIG. 3 is a top fragmentary view of the refrigeration assembly according to the exemplary embodiment showing a first and second insulative material.

DETAILED DESCRIPTION OF THE INVENTION

Figure 1:
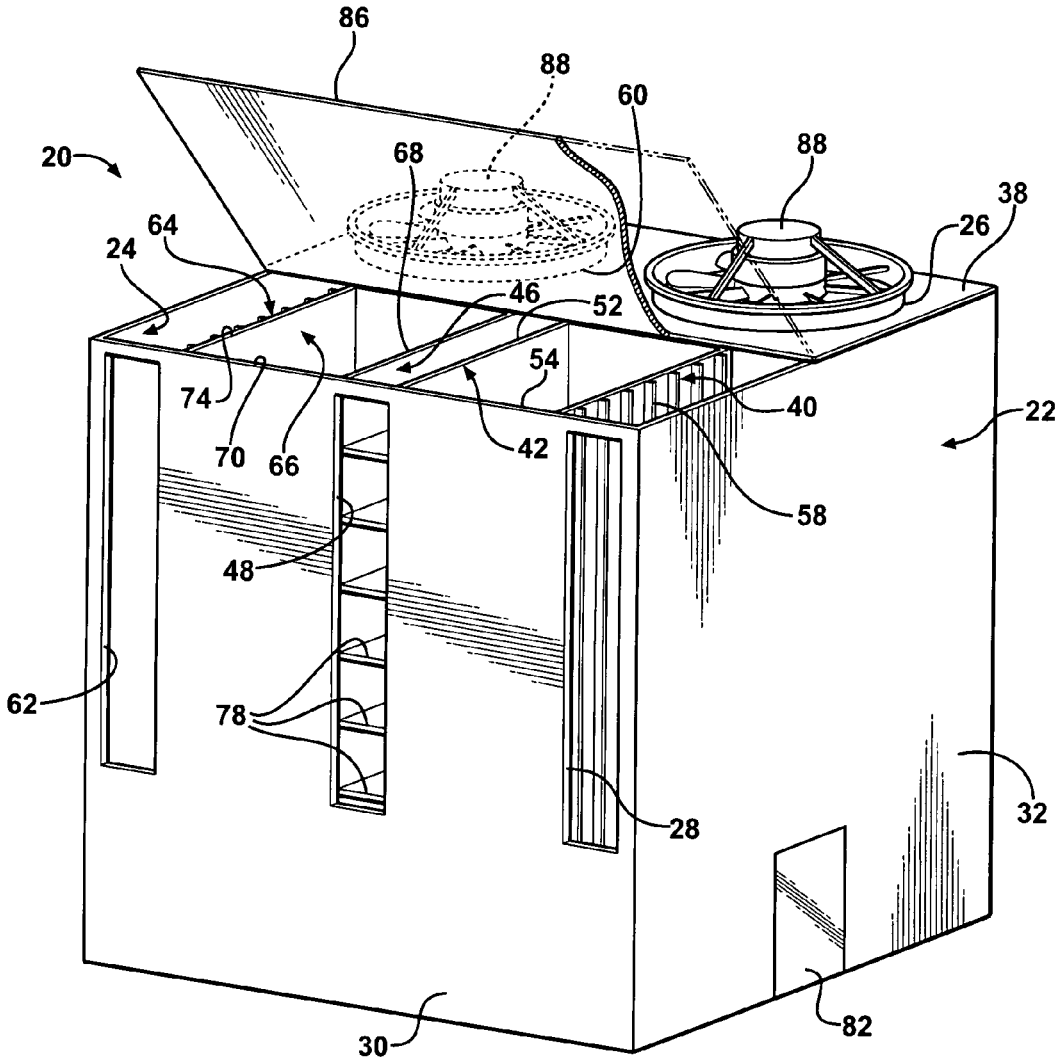
FIG. 1 is a perspective view of a refrigeration assembly according to an exemplary embodiment.

Referring to the Figures, wherein like numerals indicate corresponding parts throughout the several views, a refrigeration assembly is generally shown at 20. Referring initially to FIG. 1, the refrigeration assembly 20 includes a plurality of outer walls generally indicated at 22 defining a working chamber generally indicated at 24. The outer walls 22 include a first air inlet 26 for receiving a first airstream and a first air outlet 28 for discharging the first airstream. A front wall 30 extends between a first front wall edge and a second front wall edge. A pair of side walls 32 each extend perpendicularly to the front wall 30 from the first and second front wall 30 edges to a pair of side wall 32 edges. A rear wall 34 extends between the side wall 32 edges, and a floor 36 and a cover 38 extend above and below the working chamber 24 for enclosing the working chamber 24. The cover 38 defines the first air inlet 26, and the front wall 30 defines the first air outlet 28.

Referring next to FIG. 2, a plurality of first inner walls, generally indicated at 40, extend upwardly from the floor 36 within the working chamber 24. The first inner walls 40 define a first refrigerated chamber generally indicated at 42. The first refrigerated chamber 42 is isolated from the first airstream. The first inner walls 40 have a first section and a second section. A first panel 44 extends from one of the first inner walls 40 separating the working chamber 24 into a first working sub-chamber and a working channel generally indicated at 46. The first working sub-chamber is contiguous with the first section of the first refrigerated chamber 42, and the working channel 46 is contiguous with the second section of the first refrigerated chamber 42. A supply of water is provided for wetting the first inner walls 40 and the first panel 44 inside of the working chamber 24.

Referring generally to FIGS. 1 and 2, the front wall 30 includes a channel outlet 48 and the first panel 44 includes a plurality of apertures 50. The cover 38 defines the first air inlet 26 disposed over the first working sub-chamber so that the first airstream flows from the first air inlet 26 to the first working sub-chamber, over the first section of the first refrigerated chamber 42, and out the first air outlet 28. In addition, a portion of the first airstream flows through the apertures 50 into the working channel 46, over the second section of the first refrigerated chamber 42, and out the channel outlet 48. As the air flows over the first section of the first refrigerated chamber 42, it evaporates the water from the first inner walls 40, drawing the latent heat of evaporation away from the first refrigerated chamber 42 and cooling the first section of the first refrigerated chamber 42 by direct evaporative cooling. Additionally, as air flows through the apertures 50 of the first panel 44, it evaporates the water from the first panel 44, drawing the latent heat of evaporation from the first airstream, prior to passing the first airstream over the second section of the first refrigerated chamber 42. This cools the second section of the first refrigerated chamber 42 by indirect evaporative cooling.

The first inner walls 40 include a first channel wall 52 extending perpendicularly to the front wall 30 between a first channel wall edge abutting the front wall 30 to a first distal edge. A first insulated wall 54 overlies the front wall 30 and extends parallel thereto from the first channel wall edge to a first insulated wall edge. A first insulative material 56 is sandwiched between the first insulated wall 54 and the front wall 30, as shown in FIG. 3. Referring again to FIGS. 1 and 2, a first connector wall 58 extends about a first right angle and connects the first insulated wall edge with the first distal edge. The first connector wall 58 includes two connector wall sections extending perpendicularly to one another through the first right angle to define a rectangular shaped cross-sectional perimeter of the first refrigerated chamber 42. The first connector wall 58 is wetted by the supply of water for evaporation into the first airstream to cool the first section of the first refrigerated chamber 42. The first panel 44 extends from a corner defined at the intersection of the first distal edge of the first channel wall 52 and the first connector wall 58. The first panel 44 extends to the rear wall 34, defining the working channel 46 along the length of the refrigeration assembly 20 between the rear wall 34 and the front wall 30.

The cover 38 defines a second air inlet 60 for receiving a second airstream, and the front wall 30 defines a second air outlet 62 for discharging the second airstream. A plurality of second inner walls generally indicated at 64, extend upwardly from the floor 36 within the working chamber 24. The second inner walls 64 define a second refrigerated chamber generally indicated at 66. The second refrigerated chamber 66 is isolated from the second airstream, and includes a first section and a second section similar to the construction of the first refrigerated chamber 42. Thus, the second inner walls 64 include a second channel wall 68 extending perpendicularly to the front wall 30 from a second channel wall edge abutting the front wall 30 to a second distal edge. A second insulated wall 70 overlies the front wall 30 and extends parallel thereto from the second channel wall edge to a second insulated wall edge. A second insulative material 72 is sandwiched between the second insulated wall 70 and the front wall 30, as shown in FIG. 3. Referring again to FIGS. 1 and 2, a second connector wall 74 extends about a second right angle to connect the second insulated wall edge with the second distal edge. The second connector wall 74 includes two connector wall sections extending perpendicularly to one another through the second right angle to define a rectangular shaped cross-sectional perimeter of the second refrigerated chamber 66.

The second channel wall 68 extends parallel to the first channel wall 52 and is spaced therefrom to define the working channel 46 therebetween. A second panel 76 extends from a corner defined at the intersection of the second distal edge of the second channel wall 68 and the second connector wall 74. The second panel 76 extends to the rear wall 34, extending the working channel 46 between the rear wall 34 and the front wall 30 contiguous with the second section of the second refrigerated chamber 66. The second panel 76 also defines a second working sub-chamber contiguous with the first section of the second refrigerated chamber 66. The supply of water wets the second panel 76 and second connector wall 74 for evaporation to cool the second refrigerated chamber 66, just as with the operation of the first refrigerated chamber 42. The second panel 76 also includes apertures 50 for airflow from the second working sub-chamber, mixing with the airflow from the first working sub-chamber. A plurality of dividers 78 extend between the first and second channel walls 52, 68 and the first and second panels 44, 76, and between the rear wall 34 and the front wall 30 to define a plurality of passages within the working channel 46.

To provide the supply of water, a water tank 80 is disposed beneath the floor 36, and the first and second connector walls 58, 74 and the first and second panels 44, 76 each extend beneath the floor 36 to contact the supply of water. A wicking coating extends over the first and second connector walls 58, 74 and first and second panels 44, 76 above and below the floor 36 for wicking water by capillary action upwardly from the water tank 80 into the working sub-chambers. The water tank 80 includes a window 82 for determining the level of water within the water tank 80 and a plurality of water charge ports 84 for adding additional water to the water tank 80.

The first air inlet 26 includes a first hole in the cover 38 over the first working sub-chamber, and the second air inlet 60 includes a second hole in the cover 38 over the second working sub-chamber. The cover 38 also includes a lid 86 disposed over the first and second refrigerated chambers 42, 66 and pivotably attached to the cover 38 for selectively opening and closing the lid 86, for example with a hinge (not shown). A blower 88 is disposed in each of the first and second holes. Thus, the first and second airstreams are established in the first and second working sub-chambers, respectively, to flow over the first sections of the first and second refrigerated chambers 42, 66. A portion of each airstream flows through the apertures 50 in the first and second panels 44, 76 into the working channel 46. The mixed airstream flows through the working channel 46 over the second sections of the first and second refrigerated chambers 42, 66 and out the channel outlet 48. Thus, the exemplary embodiment can be used, for example, to store food or beverages within the refrigerated chambers 42, 66. The combined effect of the direct and indirect cooling on the first and second sections of the refrigerated chambers 42, 66 allows the assembly 20 to cool the stored items to below the wet bulb temperature of the incoming air. The only power input needed is for operating the blowers 88, which results in an assembly 20 that is more efficient than a coolant-based cycle. It should also be noted that the combined effect of using indirect and direct evaporative cooling to different sections of the same container could be applied to other applications involving the cooling of a closed container. In such a case, for example, the refrigerated chambers 42, 66 could be condenser tubes for cooling a superheated vapor to a sub-cooled liquid by abstracting the latent heat of evaporation from the refrigerant.

Figure 4:
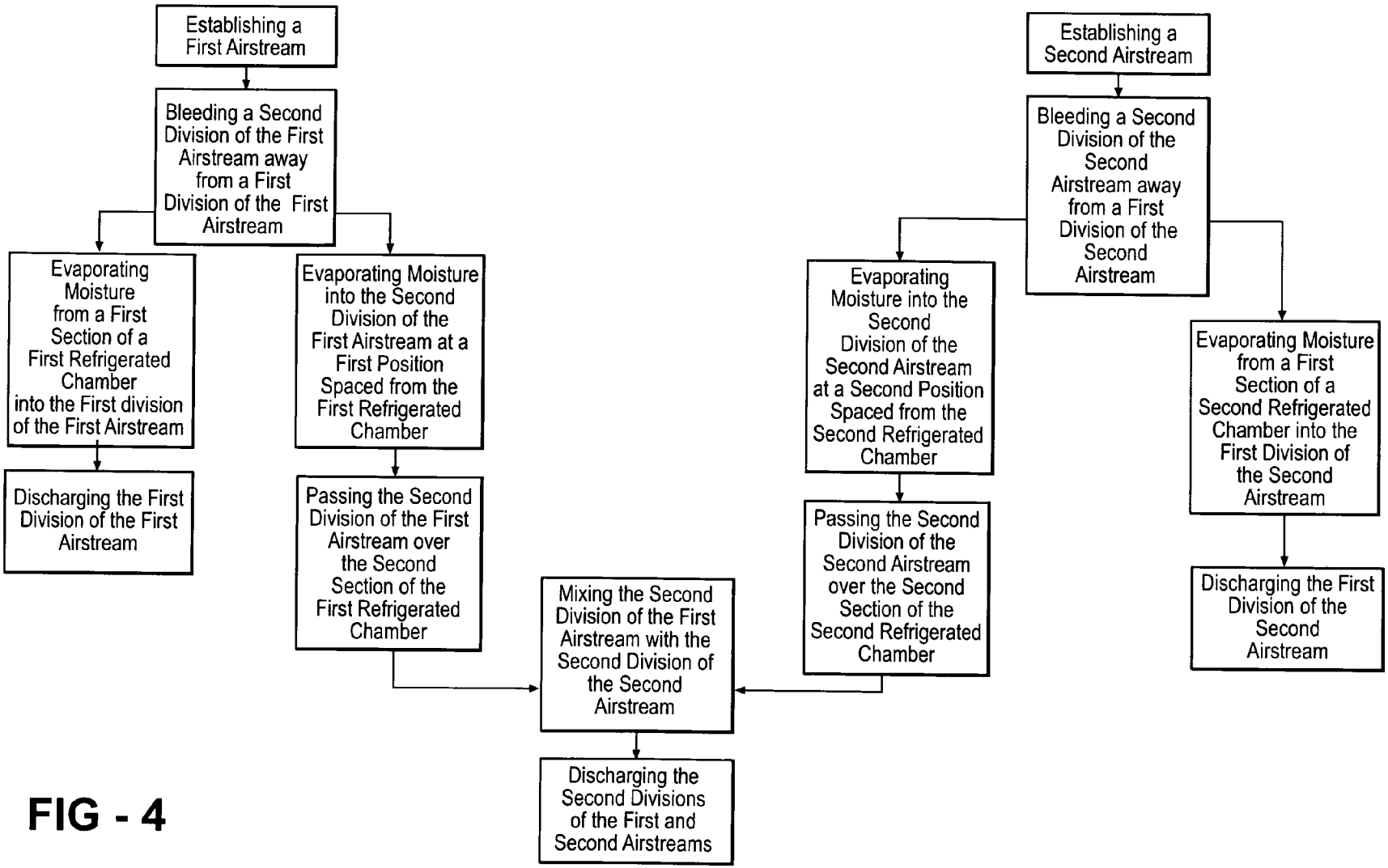
FIG. 4 is a flow chart of a method of cooling a container according to an exemplary embodiment.

Referring next to FIG. 4, a method of cooling a container, such as the first and second refrigerated chambers 42, 66, is also disclosed, and includes evaporating moisture to draw the latent heat of evaporation from the refrigerated chambers 42, 66. Moisture is evaporated from the first section of the exterior of the first refrigerated chamber 42 into a first division of a first airstream. The first division of the first airstream is then discharged, for example through the first air outlet 28. Moisture is also evaporated into a second division of the first airstream at a first position spaced from the first refrigerated chamber 42. The second division of the first airstream is then passed over the second section of the exterior of the first refrigerated chamber 42, and is then discharged, for example, through the channel outlet 48. The first airstream is established from a first air inlet 26 and is separated into the first and second divisions by bleeding the second division away from the first division.

The method also includes establishing a second airstream from a second air inlet 60 and separating the second airstream into a first division and a second division by bleeding the second division away from the first division. Moisture is evaporated into the first division of the second airstream from the first section of the exterior of the second refrigerated chamber 66. The first division of the second airstream is then discharged, for example through the second air outlet 62. Moisture is also evaporated into the second division of the second airstream at a second position spaced upstream from the second refrigerated chamber 66 to cool the second division of the second airstream. The second division of the second airstream is then passed over the second section of the exterior of the second refrigerated chamber 66, and is then discharged, for example, through the second air outlet 62. The second division of the second airstream is mixed with the second division of the first airstream prior to passing the respective second divisions over the second sections of the first and second refrigerated chambers 42, 66.

The container according to the exemplary embodiment refers to the first and second refrigerated chambers 42, 66, and can be used to store food or beverages. It should be appreciated, however, that the container could comprise, for example, condenser tubes, and the method could be applied to cooling a superheated vapor to a sub-cooled liquid by abstracting the latent heat of evaporation from the refrigerant.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A refrigeration assembly comprising;

a plurality of outer walls defining a working chamber and a first air inlet for receiving a first airstream and a first air outlet for discharging the first airstream, a plurality of first inner walls having a first section and a second section extending within said working chamber defining a first refrigerated chamber isolated from the first airstream for transferring heat from the exterior of said first inner walls to the first airstream flowing from said first air inlet through said working chamber over said first section of said first refrigerated chamber and out said first air outlet, a supply of water in fluid communication with said first inner walls for wetting said first inner walls inside of said working chamber, a first panel in fluid communication with said supply of water for wetting said first panel inside of said working chamber and said first panel extending from one of said first inner walls separating said working chamber into a first working sub-chamber contiguous with said first section of said first refrigerated chamber and a working channel contiguous with said second section of said first refrigerated chamber, and one of said outer walls including a channel outlet and said first panel including apertures for airflow from said first working sub-chamber through said working channel over said second section of said first refrigerated chamber and out said channel outlet.

2. A refrigeration assembly as set forth in claim 1 wherein said plurality of outer walls includes a cover defining said first air inlet disposed over said first working sub-chamber.

3. A refrigeration assembly as set forth in claim 2 including a first blower mounted in said first air inlet for establishing the first airstream.

4. A refrigeration assembly as set forth in claim 2 wherein said plurality of outer walls includes a front wall and a rear wall connected by at least one side wall and said plurality of first inner walls includes a first insulated wall overlying a portion of said front wall and a first connector wall extending from said first insulated wall to define said first section of said first refrigerated chamber and a first channel wall extending from said first connector wall defining a first corner therebetween and extending to said first insulated wall to define said second section of said first refrigerated chamber and said first panel extends from said first corner to said rear wall to define said working channel between said rear wall and said front wall.

5. A refrigeration assembly as set forth in claim 4 including;

said plurality of outer walls defining a second air inlet for receiving a second airstream and a second air outlet for discharging the second airstream, a plurality of second inner walls in fluid communication with said supply of water for wetting said second inner walls inside of said working chamber and having a first section and a second section and extending within said working chamber and including a second insulated wall overlying a portion of said front wall and a second connector wall defining said first section and extending from said second insulated wall and a second channel wall defining said second section and extending from said second connector wall defining a second corner therebetween and extending to said second insulated wall to define a second refrigerated chamber isolated from the second airstream for transferring heat from the exterior of said second inner walls to the second airstream flowing from said second air inlet through said working chamber over said first section of said second refrigerated chamber and out said second air outlet, said second channel wall extending parallel to and spaced from said first channel wall to define said working channel therebetween, and a second panel in fluid communication with said supply of water for wetting said second panel inside of said working chamber and said second panel extending from said second corner to said rear wall parallel to and spaced from said first panel to define said working channel contiguous with said second section of said second refrigerated chamber and to define a second working sub-chamber contiguous with said first section of said second refrigerated chamber and said second panel including apertures for airflow from said second working sub-chamber through said working channel over said second section of said second refrigerated chamber and out said channel outlet.

6. A refrigeration assembly as set forth in claim 5 wherein said cover defines said second air inlet disposed over said second working sub-chamber includes a second blower mounted in said second air inlet for establishing the second airstream.

7. A refrigeration assembly as set forth in claim 5 wherein said cover includes a lid disposed over said first and second refrigerated chambers and pivotably attached to said cover for selectively opening and closing said lid.

8. A refrigeration assembly as set forth in claim 5 wherein said first channel wall extends from a first channel wall edge abutting said front wall to a first distal edge and said second channel wall extends from a second channel wall edge abutting said front wall to a second distal edge and said first insulated wall extends from said first channel wall edge to a first insulated wall edge and said second insulated wall extends from said second channel wall edge to a second insulated wall edge and said first connector wall extends about a first right angle and connects said first insulted wall edge with said first distal edge of said first channel wall and said second connector wall extends about a second right angle and connects said second insulated wall edge with said second distal edge of said second channel wall.

9. A refrigeration assembly as set forth in claim 5 including a first insulative material sandwiched between said first insulated wall and said front wall and a second insulative material sandwiched between said second insulated wall and said front wall.

10. A refrigeration assembly as set forth in claim 5 including a water tank disposed below said working chamber to define said supply of water and said plurality of outer walls including a floor extending between said water tank and said working chamber.

11. A refrigeration assembly as set forth in claim 10 wherein said first and second connector walls and said first and second panels each extend beneath said floor.

12. A refrigeration assembly as set forth in claim 11 wherein said first and second connector walls and said first and second panels each include a wicking coating extending thereover above and below said floor for wicking water upwardly from said water tank into said first and second working sub-chambers.

13. A refrigeration assembly as set forth in claim 12 wherein said water tank includes a window for visually determining the level of water within said water tank and at least one charge port for adding additional water to said water tank.

14. A refrigeration assembly comprising;

a plurality of outer walls defining a working chamber and a first air inlet for receiving a first airstream and a first air outlet for discharging the first airstream, said plurality of outer walls including a front wall extending between a first front wall edge and a second front wall edge, said plurality of outer walls including a pair of side walls each extending from said first and second front wall edges perpendicularly to said front wall to a pair of side wall edges, said plurality of outer walls including a rear wall extending between said side wall edges, said plurality of outer walls including a floor and a cover for enclosing said working chamber, said cover defining said first air inlet and said front wall defining said first air outlet, a plurality of first inner walls having a first section and a second section extending upwardly from said floor within said working chamber defining a first refrigerated chamber isolated from the first airstream for transferring heat from the exterior of said first inner walls to the first airstream, a supply of water in fluid communication with said first inner walls for wetting said first inner walls inside of said working chamber, a first panel in fluid communication with said supply of water for wetting said first panel inside of said working chamber and said first panel extending from one of said first inner walls separating said working chamber into a first working sub-chamber contiguous with said first section of said first refrigerated chamber and a working channel contiguous with said second section of said first refrigerated chamber, said front wall including a channel outlet and said first panel including apertures for airflow from said first working sub-chamber through said working channel over said second section of said first refrigerated chamber and out said channel outlet, said cover defining said first air inlet disposed over said first working sub-chamber, said first inner walls including a first channel wall extending perpendicularly to said front wall between a first channel wall edge abutting said front wall to a first distal edge, said first inner walls including a first insulated wall overlying said front wall and extending parallel thereto from said first channel wall edge to a first insulated wall edge and including a first insulative material sandwiched between said first insulated wall and said front wall, said first inner walls including a first connector wall extending about a first right angle and connecting said first insulated wall edge with said first distal edge, said first connector wall including two connector wall sections extending perpendicularly to one another through said first right angle to define a rectangular shaped cross-sectional perimeter of said first refrigerated chamber, said first panel extending from said first distal edge of said first channel wall to said rear wall, said cover defining a second air inlet for receiving a second airstream and said front wall defining a second air outlet for discharging the second airstream, a plurality of second inner walls having a first section and a second section extending upwardly from said floor within said working chamber defining a second refrigerated chamber isolated from the second airstream for transferring heat from the exterior of said second inner walls to the second airstream, said second inner walls including a second channel wall extending perpendicularly to said front wall between a second channel wall edge abutting said front wall to a second distal edge, said second channel wall extending parallel to said first channel wall and spaced therefrom to define said working channel therebetween, said second inner walls including a second insulated wall overlying said front wall and extending parallel thereto from said second channel wall edge to a second insulated wall edge and including a second insulative material sandwiched between said second insulated wall and said front wall, said second inner walls including a second connector wall extending about a second right angle and connecting said second insulated wall edge with said second distal edge, said second connector wall including two connector wall sections extending perpendicularly to one another through said second right angle to define a rectangular shaped cross-sectional perimeter of said second refrigerated chamber, a second panel in fluid communication with said supply of water and extending from said second distal edge of said second channel wall to said rear wall to extend said working channel between said rear wall and said front wall contiguous with said second section of said second refrigerated chamber and to define a second working sub-chamber contiguous with said first section of said second refrigerated chamber, a plurality of dividers extending between said first and second channel walls and said first and second panels and between said rear wall and said front wall to define a plurality of passages within said working channel, said second panel including apertures for airflow from said second working sub-chamber mixing with the airflow from said first working sub-chamber and flowing through said working channel over said second sections of said first and second refrigerated chambers and out said channel outlet, said cover defining said second air inlet disposed over said second working sub-chamber, said first and second connector walls and said first and second panels each extending beneath said floor, a water tank disposed beneath said floor to provide said supply of water to said first and second connector walls and said first and second panels for evaporation into the airstream, said water tank including a window for determining the level of water within said water tank and a plurality of water charge ports for adding additional water to said water tank, said first and second connector walls and said first and second panels each including a wicking coating extending thereover above and below said floor for wicking water upwardly from said water tank into said working sub-chambers, said cover including a lid disposed over said first and second refrigerated chambers and pivotably attached to said cover for selectively opening and closing said lid, said first air inlet including a first hole in said cover over said first working sub-chamber and said second air inlet including a second hole in said cover over said second working sub-chamber, and a blower disposed in each of said first and second holes.

15. A method of cooling a container comprising;

evaporating moisture into a first division of a first airstream from a first section of an exterior of a first refrigerated chamber to cool the first refrigerated chamber, evaporating moisture into a second division of the first airstream at a first position spaced from the first refrigerated chamber to cool the second division of the first airstream, and passing the second division of the first airstream over a second section of the exterior of the first refrigerated chamber to cool the first refrigerated chamber, and establishing the first airstream from a first air inlet and separating the first airstream in to the first and second divisions by bleeding the second division away from the first division.

16. A method as set forth in claim 15 further defined as;

establishing a second airstream from a second air inlet and separating the second airstream into a first division of the second airstream and a second division of the second airstream by bleeding the second division away from the first division, evaporating moisture into the first division of the second airstream from a first section of the exterior of a second refrigerated chamber to cool the second refrigerated chamber, evaporating moisture into the second division of the second airstream at a second position spaced upstream from the second refrigerated chamber to cool the second division of the second airstream, and passing the second division of the second airstream over a second section of the exterior of the second refrigerated chamber to cool the second refrigerated chamber.

17. A method as set forth in claim 16 further defined as mixing the second division of the second airstream with the second division of the first airstream prior to passing the second divisions of the first and second airstreams over the second sections of the first and second refrigerated chambers.

18. A method as set forth in claim 17 further defined as discharging the first division of the first airstream after evaporating moisture from the first section of the first refrigerated chamber and discharging the first division of the second airstream after evaporating moisture from the first section of the second refrigerated chamber and discharging the second divisions of the first and second airstreams after passing each second division over the second sections of the first and second refrigerated chambers.

19. A method as set forth in claim 16 further defined as wicking water from a supply of water to the first sections of the first and second refrigerated chambers and wicking water to the first and second positions spaced upstream from the first and second refrigerated chambers.

* * * * *